US006736067B2

(12) United States Patent
Patton

(10) Patent No.: US 6,736,067 B2
(45) Date of Patent: May 18, 2004

(54) METHOD FOR PRINTING AND VERIFYING LIMITED EDITION STAMPS

(75) Inventor: David L. Patton, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/903,346

(22) Filed: Jul. 11, 2001

(65) Prior Publication Data

US 2002/0056988 A1 May 16, 2002

Related U.S. Application Data

(62) Division of application No. 09/534,433, filed on Mar. 23, 2000.

(51) Int. Cl.[7] ..... B41C 1/04
(52) U.S. Cl. ..... 101/483; 101/484
(58) Field of Search ..... 101/483, 484; 705/404, 401, 60–62

(56) References Cited

U.S. PATENT DOCUMENTS

| | | | | |
|---|---|---|---|---|
| 4,591,707 A | | 5/1986 | Stenzel et al. | |
| 4,725,718 A | | 2/1988 | Sansone et al. | 235/495 |
| 4,796,921 A | | 1/1989 | Neiman | |
| 4,797,937 A | | 1/1989 | Tajima | |
| 4,831,555 A | | 5/1989 | Sansone et al. | |
| 4,978,145 A | * | 12/1990 | Mikhail | 283/71 |
| 5,120,089 A | | 6/1992 | Guttag | |
| 5,149,139 A | | 9/1992 | Kaule | |
| 5,160,171 A | | 11/1992 | Gregory et al. | |
| 5,267,754 A | | 12/1993 | Kaule | |
| 5,267,756 A | | 12/1993 | Molee et al. | |
| 5,368,334 A | | 11/1994 | Christy et al. | |
| 5,374,976 A | | 12/1994 | Spannenburg | |
| 5,459,819 A | * | 10/1995 | Watkins et al. | 395/117 |
| 5,557,721 A | * | 9/1996 | Fite et al. | 395/148 |
| 5,667,249 A | | 9/1997 | Critelli | |
| 5,685,570 A | | 11/1997 | Gray et al. | |
| 5,751,590 A | | 5/1998 | Cannon et al. | |
| 5,835,639 A | | 11/1998 | Honsinger et al. | |
| 5,856,266 A | | 1/1999 | Gasper et al. | 503/206 |
| 5,859,920 A | | 1/1999 | Daly et al. | |
| 5,905,819 A | | 5/1999 | Daly | |
| 5,919,730 A | | 7/1999 | Gasper et al. | |
| 6,098,057 A | * | 8/2000 | Dlugos | 705/407 |
| 6,101,487 A | * | 8/2000 | Yeung | 705/410 |
| 6,249,777 B1 | * | 6/2001 | Kara et al. | 705/404 |
| 6,349,292 B1 | * | 2/2002 | Sutherland et al. | 705/62 |
| 6,438,530 B1 | * | 8/2002 | Heiden et al. | 705/401 |
| 6,470,327 B1 | * | 10/2002 | Carroll et al. | 705/401 |

FOREIGN PATENT DOCUMENTS

| | | |
|---|---|---|
| CA | 2265326 | 8/2000 |
| EP | 0 782 068 A1 | 7/1997 |
| EP | 0 944 027 A2 | 9/1999 |

OTHER PUBLICATIONS

Kodak Professional 8650R Thermal Printer Specifications; p. 1 of 1.
Kodak Photo Printer 4700 User Guide;1999.

* cited by examiner

*Primary Examiner*—Anthony H. Nguyen
(74) *Attorney, Agent, or Firm*—Frank Pincelli

(57) ABSTRACT

A limited edition stamp and method for printing limited edition stamps from a plurality of different printers and locations. The limited edition stamps each having a unique ID not visible under normal viewing conditions. The unique ID number is allocated to different printers by a single computer that is communication with all of the printers.

2 Claims, 4 Drawing Sheets

METHOD FOR PRINTING AND VERIFYING LIMITED EDITION STAMPS

CROSS REFERENCE TO RELATED APPLICATIONS

This is a divisional application Ser. No. 09/534,433 filed Mar. 23, 2000.

FIELD OF THE INVENTION

This invention relates to the printing and verification of limited edition stamps.

BACKGROUND OF THE INVENTION

To ensure the quality and authenticity of official United States postage stamps they are printed using a Gravure process. The Gravure process is capable of creating images of very high resolution, way beyond the capabilities of most common printers. The Gravure process is an intaglio process. It uses a depressed or sunken surface etched into a copper cylinder to create the image and the unetched surface of the cylinder representing non-printing areas. The cylinder rotates in a bath of ink and the etched area picks up the ink and transfers it to the media creating the image. Gravure printing is considered excellent for printing highly detailed marks or pictures. High cylinder making expense usually limits use of Gravure rollers to long printing runs. The Gravure process described for printing stamps does not lend itself to economically printing small batches of stamps in small quantities, for example, batches from about of 10 to 10,000. Nor does the Gravure process for printing stamps allow for each individual stamp to be differentiated from the stamp next to it in a sheet. As an example an artist can create an etching and print a limited number of copies. The artist than hand numbers each individual copy as $1/1{,}000$, $2/1{,}000$ and so forth. Consumers or collectors who buy the copies then know there are a limited number of copies and what number they have purchased. It would be very desirable in the eye of a stamp collector to be able to buy a sheet of stamps from a limited printing comprised of a block of individually numbered stamps each stamp marked with an individual number such as $1/10{,}000$. The problem with the method that is currently used to produce stamps is it is not possible to economically print stamps with this number feature in small quantities. U.S. Pat. No. 5,120,089 describes a method for adding a distinguishing mark to a sheet of stamps after the stamps have been printed. The problem is the mark is added after the printing and is not part of the original stamp.

Digital printers such as KODAK PS 8650 Color Printer, or a KODAK Photo Printer 4700 are capable of printing stamps economically in small quantities, while meeting the same printing quality requirements previously met using the Gravure process. The advent of digital printing technology now allows the printing of stamps on demand in small quantities at remote locations. Digital printing technologies allow stamps to be printed from digital files stored on servers. The stamp image files can be downloaded to remote printing locations and printed on site in small quantities on demand. Commonly-assigned U.S. patent application Ser. No. 09/359,152, filed Jul. 22, 1999, entitled "Authorizing the Printing of Digital Images" by Patton et al describes a method for sending a digital image file to an authorizing agency. This reduces the time and cost required producing stamps. It also allows the USPO to offer larger number of choices of images from which the public can choose for a stamp. This is possible because the stamp image can exist as files and not as etchings on expensive Gravure cylinders. Commonly-assigned U.S. patent application Ser. No. 09/378,159, filed Aug. 19, 1999, entitled "System for Customizing and Ordering Personalised Postage Stamps" by Patton et al describes a method for selecting stamps from a digital image file located on a server at an authorizing agency. Using digital technology enables the USPO to offer the consumer a library of image from which to choose. The consumer is able to select what image they want printed as a stamp and how many they want from a library of stamp images stored on a server. A problem that arises with the printing of stamps from image files at remote post office locations is the increased possibility of having counterfeit stamps being printed at unauthorized locations.

U.S. Pat. No. 4,725,718 discloses using an encrypted message based upon the postage amount and the mail address as a method to insure authenticity of the postage. U.S. Pat. No. 4,831,555, discloses a postage applying system where the device used for printing of postage and the accounting unit are separated from one another by an unsecured link and the authenticity of the postage is insured by encryption. Both of these patents disclose printing of postage using a device such as an off-the-shelf printer. The postage is printed directly onto the envelope or onto a label, which is adhered to the envelope. The postage printed is akin to postage printed using a postage meter. When the postage is printed using an off-the-shelf printer and not a secured postage meter, an encryption scheme as described in the patents previously set forth is used. There are several problems with using off-the-shelf printers and the method described. The postage consists of a two-dimensional bar code and sometimes indicia. The indicia printed using this method are typically very rudimentary and are no more than line drawings. These printers do not have means for insuring that the quality and detail are properly maintained to meet the standards required of an official postage stamp. Also if a user or printer makes a mistake when printing the postage the value of the stamp may be lost or difficult for the consumer to obtain reimbursement.

When printing limited edition stamps that are individually numbered using a printer at a remote location, there is a problem of knowing what numbers have been previously used. For example if the USPO wanted to offer 10,000 stamps to be printed as a limited edition. The consumer can go into any US Post Office and request a sheet of stamps until the 10,000 stamps have been printed. Each stamp on the sheet of stamps must be individually numbered with a unique number. How does each individual post office and each printer, when there is more than one printer, know what number have already been used to print stamps.

Another problem with the existing stamp printing process is that it is not easy or economical to be able to offer stamps for sale for a specific period of time. For example, the US Post Office would like to offer a stamp that would be available to the consumer only from July 1 to September 30.

The present invention is directed to limited edition stamps and a method for producing them, which overcome the problems of the prior art.

SUMMARY OF THE INVENTION

The above, and other objects, advantages and novel features of the present invention will become more apparent from the accompanying detailed description thereof when considered in conjunction with the following drawings.

In accordance with one aspect of the present invention there is provided a method of printing limited edition official postal stamps from a plurality of different printers, the limited edition official postal stamps each having a unique ID, a visible indicia identifying said limited edition official postal stamp as being a limited edition and a second indicia not capable of being scanned which is not visible under normal viewing conditions for confirming that said limited edition official postal stamp is a valid limited edition official postal stamp, comprising the steps of:

allocating a selected number of said unique IDs to one of said plurality of different printers; and printing said selected number of limited edition official postal stamps with said unique IDs by said one printer.

In accordance with another aspect of the present invention there is provided A method of printing limited edition official postal stamps from a plurality of different locations, the limited edition official postal stamps each having a unique ID, a visible indicia identifying said limited edition official postal stamp as being a limited edition and a second indicia not capable of being scanned which is not visible under normal viewing conditions for confirming that said limited edition official postal stamp is a valid limited edition official postal stamp comprising the steps of:

allocating said unique IDs for a selected number of limited edition official postal stamps to one location of said plurality of different locations; and printing said selected number of limited edition official postal stamps at said one location.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
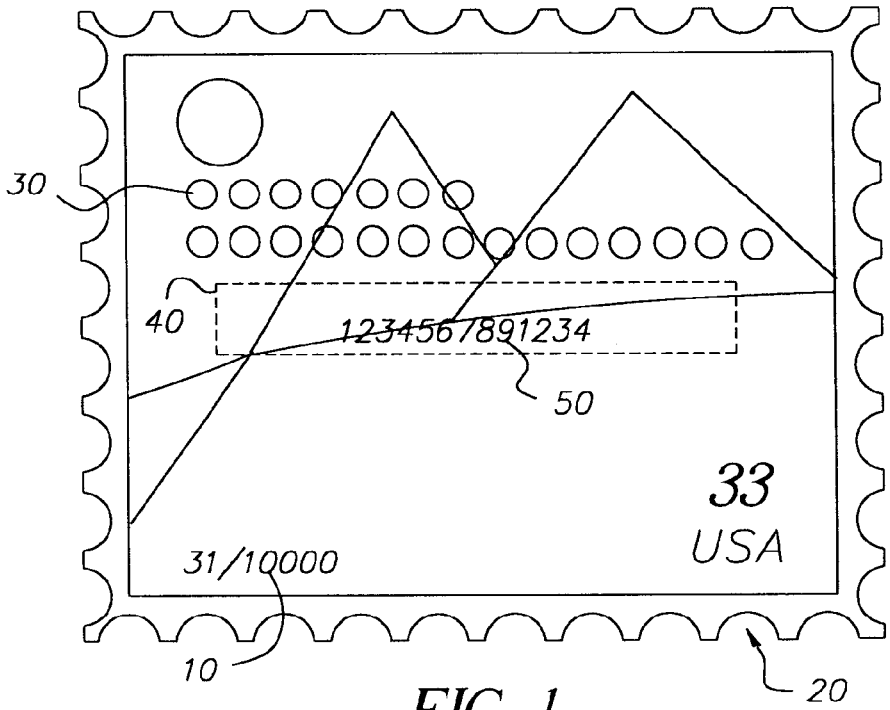
FIG. 1 is a plan view of a limited edition stamp made in accordance with the present invention.

Now referring to FIG. 1 there is illustrated a plan view of a limited edition stamp 20 made in accordance with the present invention. The stamp 20 having a first visual indicia 10 in the form of a number identifying the stamp 20 as a limited edition stamp and a second invisible machine-readable indicia 30 which confirms the readable indicia 10. The second indicia 30 not capable of being scanned for reproduction as disclosed in U.S. Pat. No. 5,919,730 to Gasper et al, but is capable of being read under special viewing conditions for confirming that the stamp 20 is a limited edition stamp. The stamp has a third indicia area 40 having a unique identification number 50. The unique identification number 50 is used to identify the printer 135 shown in FIG. 3 (as further described herein) used to print the stamp 20 or sheet of stamps 150 shown in FIG. 2. The unique identification number 50 may be used to identify the remote location 70 shown in FIG. 3 where the stamps are to be printed. The unique identification number 50 may be used to identify both the printer used and it's location. The information printed in the third indicia area 40 may be eye readable or not visible to the eye under normal viewing conditions such as infrared or UV lights. In the embodiment illustrated the marking material is a fluid, and in particular an infrared or UV ink. However any suitable ink, dye and/or pigment may be used. Use of an infrared or UV light causes the indicia 30 or the unique identification number 50 to be invisible under normal viewing conditions. Eastman Chemical Company under the trade name N.I.R.F. (near-infrared fluorophore) inks sells appropriate suitable ink for placement of the information. The information printed in the third indicia area 40 may be encrypted as disclosed in U.S. Pat. Nos. 5,859,920; 5,905,819; and 5,835,639 which are hereby incorporated by reference. It is also disclosed in pending U.S. Ser. No. 08/848,112, filed Apr. 28, 1997, by Chris W. Honsinger et al, entitled METHOD FOR GENERATING AN IMPROVED CARRIER FOR USE IN AN IMAGE DATA EMBEDDING APPLICATION, which is hereby incorporated by reference. The information printed in the third indicia area 40 may be printed in a form that can be read or observed by a normal digital scanner.

Figure 3:
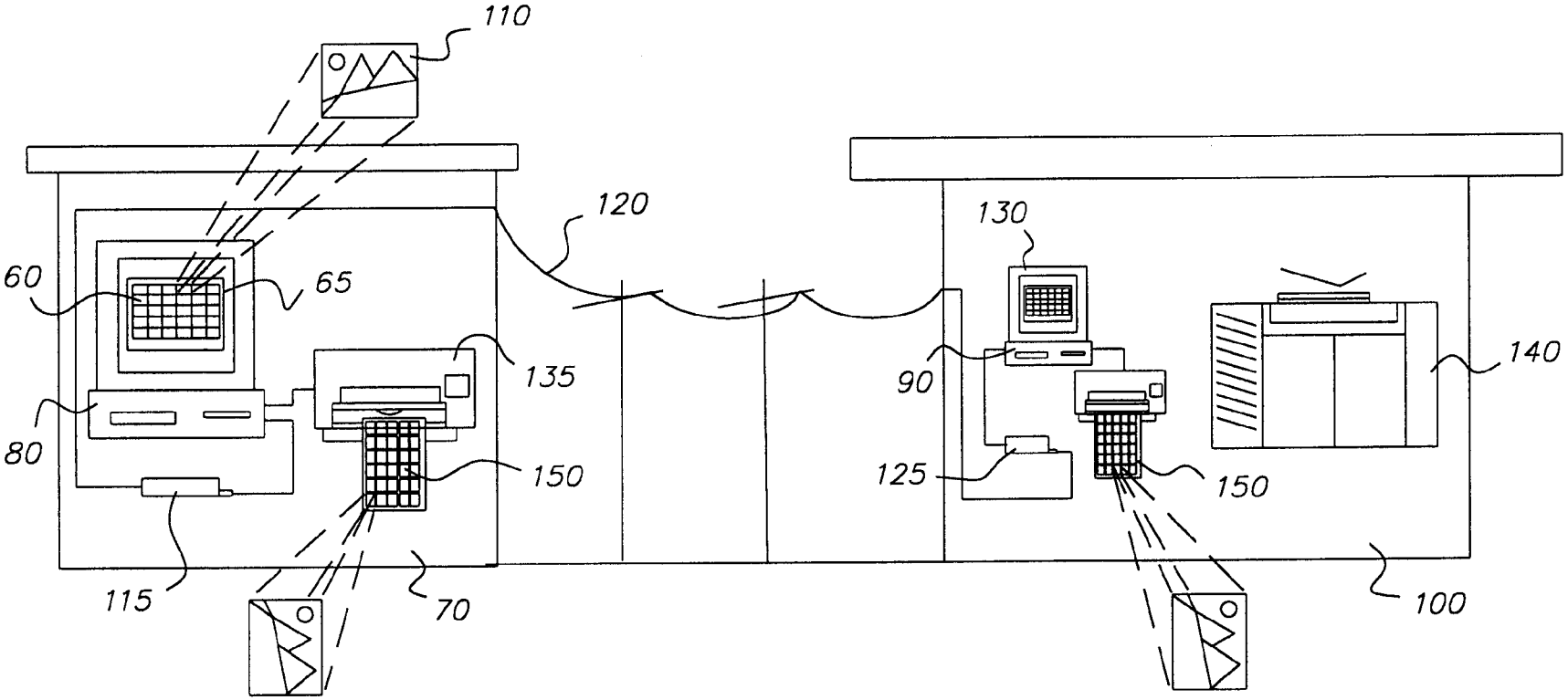
FIG. 3 is a schematic diagram of a system for printing limited edition stamps if FIGS. 1 and 2 from a plurality of different printers, the limited edition stamps each having a unique ID.

Now referring to FIG. 3, there is illustrated in schematic form a system for printing limited edition stamps from a plurality of different printers at a plurality of locations. More particularly limited edition stamp images 60 are viewed on a monitor 65 at a remote location 70. The source of the images 60 can be image files stored in digital format on a server 90 at a central location 100. When an image 110 is selected at the remote location 70, image locator information and the location of where the image was selected is electronically transmitted as signals from a computer 80 at the remote location 70 to a server 90 at the central location 100. The signal is transmitted from the remote location's computer 80 connected via a modem 115 to a communication channel 120 such as the Internet. The signal is received via a modem 125 connected to a server 90 at the central location 100 where the information is received and stored in a memory 130. The transmitted information is comprised of, but not limited to, a unique identification number for the remote location, the image locator information, the number of stamps to be printed at the remote location, and a unique identification number for the printer 135 at the remote location 70. The image locator information identifies the digital file of the selected image 110 and where the file is located on the server 90 at the central location 100. The consumer who is purchasing the limited edition stamps has the option of designating the quantity of stamps to be printed and the location where the stamps are to be printed. For example the consumer may be making his or her stamp selection at their local post office, and request the stamps be printed at the central post office and be sent to his or her home address through the mail system. Likewise the consumer may request his or her stamp selection be printed at their local post office while they wait. In either case the digital image of the stamp is stored on the server 90,at the central location 100, and the requested image is downloaded to the appropriate printer at the requested location. If the stamps are to be printed at a remote location 70 where the quantity of stamps may be small, a printer such as a KODAK PS 8650 Color Printer or a KODAK Photo Printer 4700 may be used to produce a sheet of limited edition stamps 150. If the stamps are to be printed at the central location 100 where the quantity of stamps may be large, a printer such as a digital electrophotographic printer 140 such as an Indigo-E-1000 may be used to produce a sheet of limited edition stamps 150. In each case the location of where the stamps are printed and the printer used to print the stamps are uniquely identified and the unique identification number 50 (See FIG. 1) is printed on each stamp 20 on the sheet of stamps 150.

Figure 2:
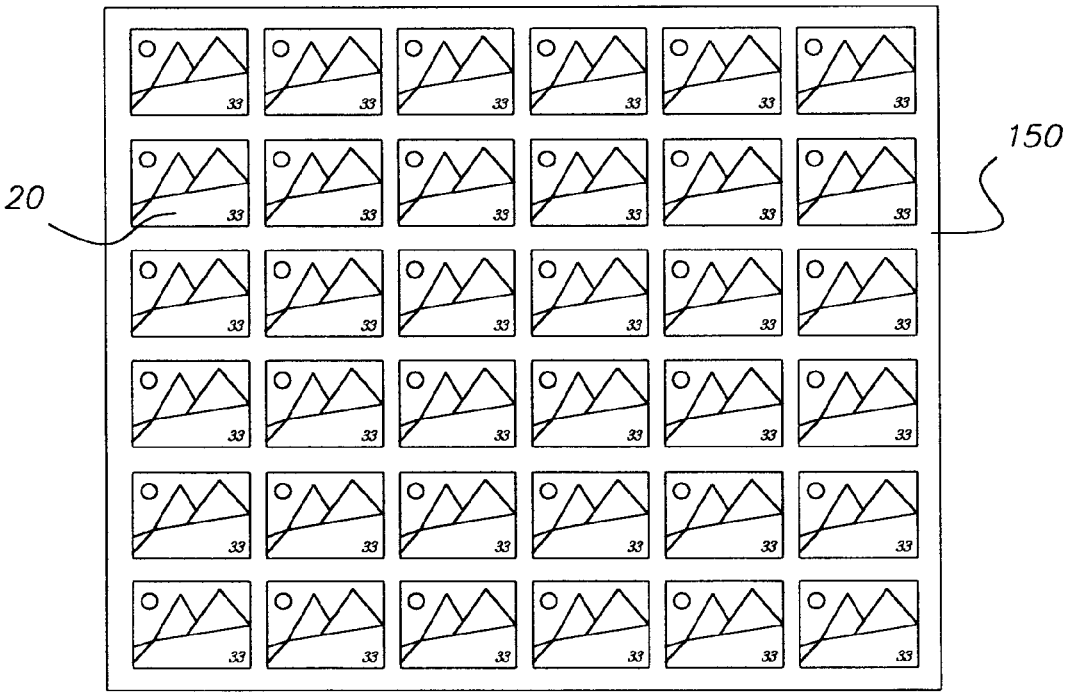
FIG. 2 is a schematic drawing of a sheet of limited edition stamps of FIG. 1.

Now referring to FIG. 2, there is illustrated in schematic form a sheet 150 of limited edition stamps printing using the system described in FIG. 3. The number of limited edition stamps contained in the sheet 150 may vary in accordance with the capacity of the printers 135 or 140 used to print the stamps, the size of the stamps and the quantity of stamps ordered by the consumer.

Now referring back to FIG. 1, each stamp 20 in the sheet 150 shown in FIG. 2 is consecutively numbered with a first visual indicia 10 identifying each stamp with a number in the sequence. For example the stamp 20 is identified as stamp 31 out of the 10,000 stamps printed. Each stamp in the sheet 150 is printed with a second indicia 30 not shown in FIG. 2 not capable of being scanned for reproduction but visible under special viewing conditions for confirming that the stamp 20 is a limited edition stamp. The stamp 20 has a third indicia area 40 having a unique identification number 50 which designates both the printer used to produce the stamps and the location where the stamp was printed. The information printed in the third indicia area 40 may be eye readable or not visible to the eye under normal viewing conditions.

Figure 4:
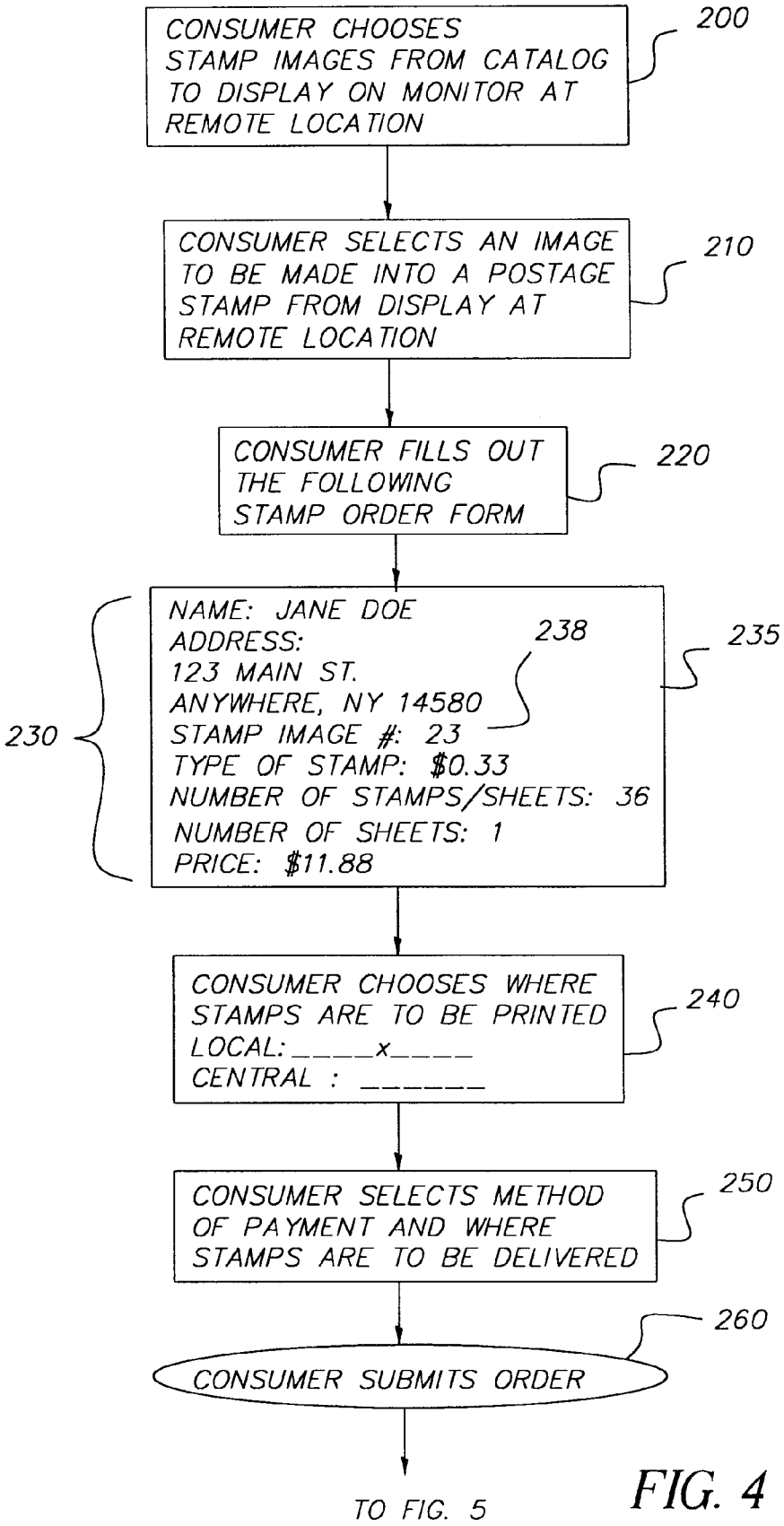
FIGS. 4 and 5 together illustrate a flow chart of a system for selecting and printing limited edition stamps in accordance with the present invention.
Figure 5:
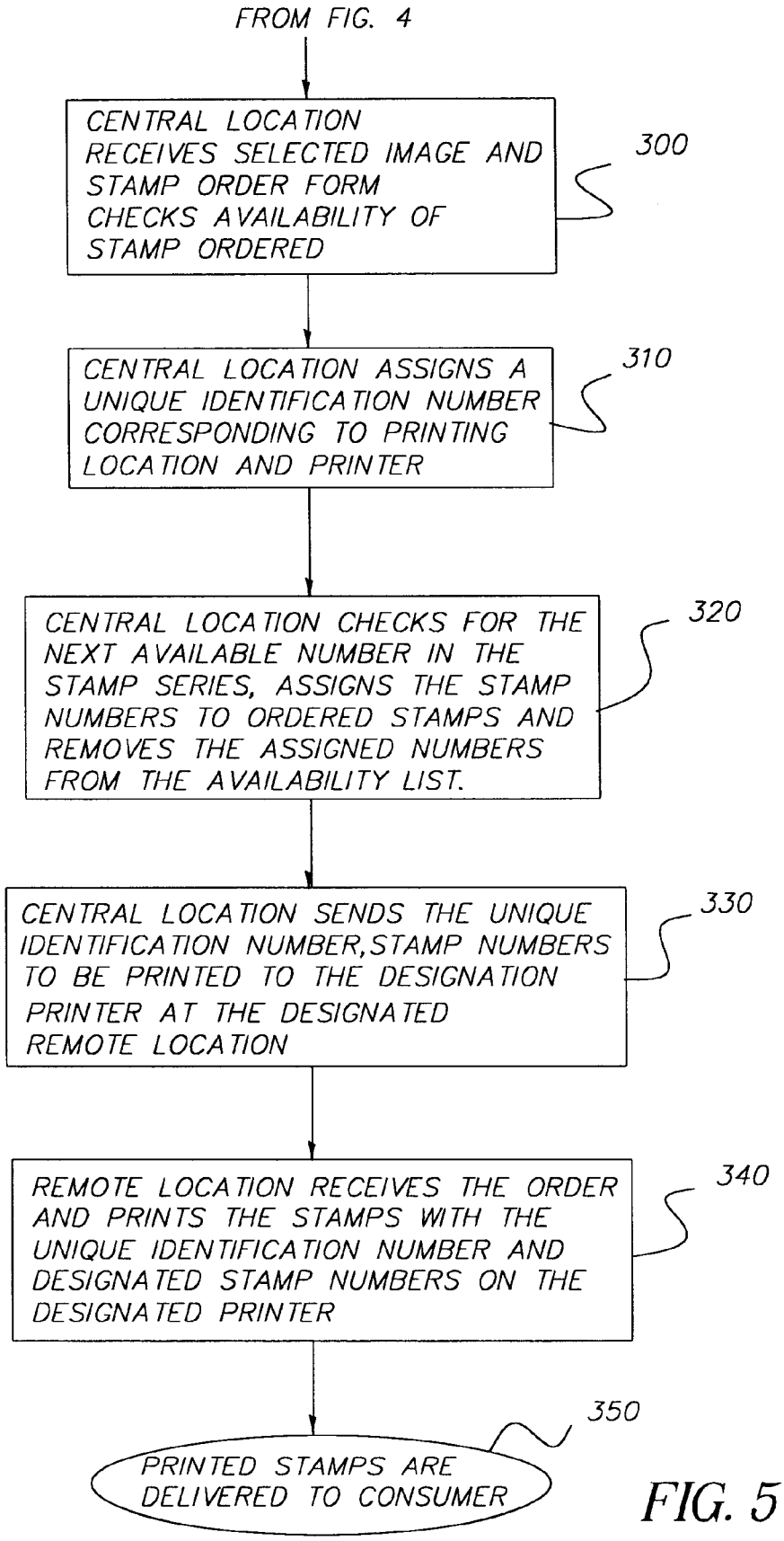

Now referring to both FIGS. 4 and 5 there is illustrated a flow chart of a system for selecting and printing limited edition stamps in accordance with the present invention. Referring to FIG. 4A consumer chooses a set of stamp images 60 from a catalog of stamp images displayed on the monitor 65 (See FIG. 2) at the remote location 70 as shown in step 200. The consumer selects a stamp image 110 from the set of stamp images 60 displayed as shown in step 210. After the desired stamp image 110 is selected, the consumer fills out step 220 the stamp order form 230 shown in step 235. The information on the stamp order form 230 is comprised of but not limited to the consumer's name, address, the stamp image number 238 shown in step 235. The consumer is shown the type of stamp and number of postage stamps to be printed on each sheet. The consumer indicates on the stamp order form 230 the number of sheets they wish to purchase. When the form 230 is completed, the form 230 shows the consumer the price of the order. The consumer then chooses where they would like the stamps printed, locally at the location where they are ordering the stamps or centrally as shown in step 240. The consumer selects the method of payment as shown in step 250 and submits the order as shown in step 260.

Now referring to FIG. 5 there is illustrated a continuation of the flow chart of FIG. 4. The consumer's submitted order from the remote location 70 comprised of the selected image 110 and the stamp order form 230 is received at the central location 100 as shown in step 300. The central location 100 checks on the availability of the selected stamp 110. The central location 100 assigns a unique identification number 50 corresponding to the printing locations 70, 100 and printers 135, 140 as shown in step 310. The central location 70 checks for the next available number 10 in the stamp series, assigns numbers to cover the number of stamps ordered and removes the assigned numbers from the availability list as shown in step 320. The central location 70 transmits the unique identification number 50, stamp numbers 10 and stamp image file 110 to the designated printer 135 at the designated remote location 70 as shown in step 330. The designated remote location 70 receives the unique identification number 50, stamp numbers 10 and stamp image file 110 as shown in step 340. The remote location 70 prints the sheet of stamps 150 which were selected with the unique identification number 50 and the assigned stamp numbers 10 on the printer 135 designated by the unique identification number 50. The printed sheet of stamps 150 is given to the consumer as shown in step 350.

The invention has been described in detail with particular reference to certain preferred embodiments thereof, but it will be understood that variations and modifications can be effected within the scope of the present invention, the present invention being defined by the following claims.

PARTS LIST

10 first visual indicia
20 limited edition stamp
30 second invisible machine-readable indicia
31 stamp
40 third indicia area
50 unique identification number
60 limited edition stamp images
65 monitor
70 remote location
80 computer
90 server
100 central location
100 stamp image
115 modem
120 communication channel
125 modem
130 memory
135 printer
140 printer
150 sheet of stamps
200 step
210 step
220 step
230 step
235 step
238 stamp image number
240 step
250 step
260 step
300 step
310 step
320 step
330 step
340 step
350 step

What is claimed is:

1. A method of printing limited edition official postal stamps from a plurality of different printers, the limited edition official postal stamps each having a unique ID, a visible indicia identifying said limited edition official postal stamp as being a limited edition and a second indicia not capable of being scanned which is not visible under normal viewing conditions for confirming that said limited edition official postal stamp is a valid limited edition official postal stamp comprising the steps of:

allocating a selected number of said unique IDs to one of said plurality of different printers; and printing said selected number of limited edition official postal stamps with said unique IDs by said one printer.

2. A method of printing limited edition official postal stamps from a plurality of different locations, the limited edition official postal stamps each having a unique ID, a visible indicia identifying said limited edition official postal stamp as being a limited edition and a second indicia not capable of being scanned which is not visible under normal viewing conditions for confirming that said limited edition official postal stamp is a valid limited edition official postal stamp comprising the steps of:

allocating said unique IDs for a selected number of limited edition official postal stamps to one location of said plurality of different locations; and printing said selected number of limited edition official postal stamps at said one location.

* * * * *